US007216370B1

(12) United States Patent
Warner et al.

(10) Patent No.: US 7,216,370 B1
(45) Date of Patent: May 15, 2007

(54) TROUSERS WITH KNEE PADS IN ENCLOSED POCKETS

(76) Inventors: Robert J. Warner, 312 Hickory Grove Dr., Thousand Oaks, CA (US) 91320; Margaret A. Warner, 312 Hickory Grove Dr., Thousand Oaks, CA (US) 91320

( * ) Notice: Subject to any disclaimer, the term of this patent is extended or adjusted under 35 U.S.C. 154(b) by 0 days.

(21) Appl. No.: 11/377,604

(22) Filed: Mar. 17, 2006

Related U.S. Application Data

(60) Provisional application No. 60/756,431, filed on Jan. 5, 2006.

(51) Int. Cl.
*A41D 13/06* (2006.01)

(52) U.S. Cl. ..... 2/23; 2/24

(58) Field of Classification Search ..... 2/22–24, 2/62, 79, 227, 69, 242, 267, 247–253, 256, 2/257, 455, 404, 407, 911; 128/881, 882; 602/23, 26, 61, 62, 63
See application file for complete search history.

(56) References Cited

U.S. PATENT DOCUMENTS

| | | | | |
|---|---|---|---|---|
| 3,168,746 | A * | 2/1965 | Smith | 2/24 |
| 5,729,832 | A * | 3/1998 | Grilliot et al. | 2/23 |
| 6,014,771 | A * | 1/2000 | Kirven | 2/23 |
| 6,425,135 | B1 * | 7/2002 | Aldrich | 2/23 |
| 6,751,804 | B1 * | 6/2004 | Warner et al. | 2/23 |

* cited by examiner

*Primary Examiner*—Tejash Patel
(74) *Attorney, Agent, or Firm*—Allan M. Shapiro

(57) ABSTRACT

A series of vertically overlapping pockets is sewn onto an attachment panel which is sufficiently wide to be sewn into the trouser leg at the inseam and outseam. It is long enough to be seamed into the waistband at the top. When the attachment panel is sewn into the fabric of the trousers, the series of overlapping pockets is positioned at the knee. A foam kneepad is inserted into a selected pocket. Each pocket has a top closure such as a hook-and-loop fastener to hold the kneepad in place and close the top of the pocket. Using different pockets selectively positions the kneepads so that they protect both the knee and the adjacent shin.

13 Claims, 3 Drawing Sheets

TROUSERS WITH KNEE PADS IN ENCLOSED POCKETS

CROSS REFERENCE

This application relies for priority on my provisional application entitled "Trousers with Adjustable Location Knee Pads" Ser. No. 60/756,431 filed Jan. 5, 2006.

BACKGROUND OF THE INVENTION

Many persons must kneel in performance of their work. For example, carpet installers must kneel when attaching nail strips around the periphery of the area to be carpeted. They must also kneel when the carpet sections are joined and when the carpet is stretched. This kneeling is hard on the knees unless they are protected. Other occupations also require kneeling. For example, plumbers must kneel to do plumbing work near the floor. Carpenters must kneel to do carpentry at low levels. This is particularly true in finish carpentry for the installation of baseboards, trim and cabinets. In the cargo bays of aircraft, baggage handlers must crawl and kneel to load and unload baggage.

In addition, there are non-work situations where kneeling is helpful. With any long term effort near the ground, kneeling is preferable to bending. Thus, garden work often requires kneeling for attention to plants or planting. There are pads which can be carried along and put in position for kneeling. There are foam knee pads which can be strapped around the leg so that they are presumably in position when the user wants to kneel. However, such kneepads are inconvenient, or do not remain in position. Thus, there is a need for structure which properly positions the kneepad and holds it in place.

SUMMARY OF THE INVENTION

In order to aid in the understanding of this invention, it can be stated in essentially summary form that it is directed to structure which can be placed interiorly of the trouser leg to position a closeable kneepad pocket on the interior of the trouser leg. Each pocket is closeable and a pad is provided to insert into a selected one of the pockets to permit selectable positioning of the kneepad.

It is thus a purpose and advantage of this invention to provide a structure including a plurality of closeable pockets which can be attached to the inside of the trouser leg, which permits the selectable positioning of a soft knee pad.

It is another purpose and advantage of this invention to provide trousers which have in association therewith a knee pad structure which includes selectable positioning of a soft knee pad to include cushioning of both the user's knee and upper shin.

It is another purpose and advantage of this invention to provide a structure which has a plurality of spaced closeable pockets and a foam knee pad, with the pockets and knee pad being configured so that the knee pad can be inserted into a selected pocket to be releasably retained therein.

It is another important purpose and advantage to place the pockets for the pad on the interior of the trousers and to close the interior pockets to aid in the convenience of putting on the trousers.

The features of this invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENTS

Figure 1:
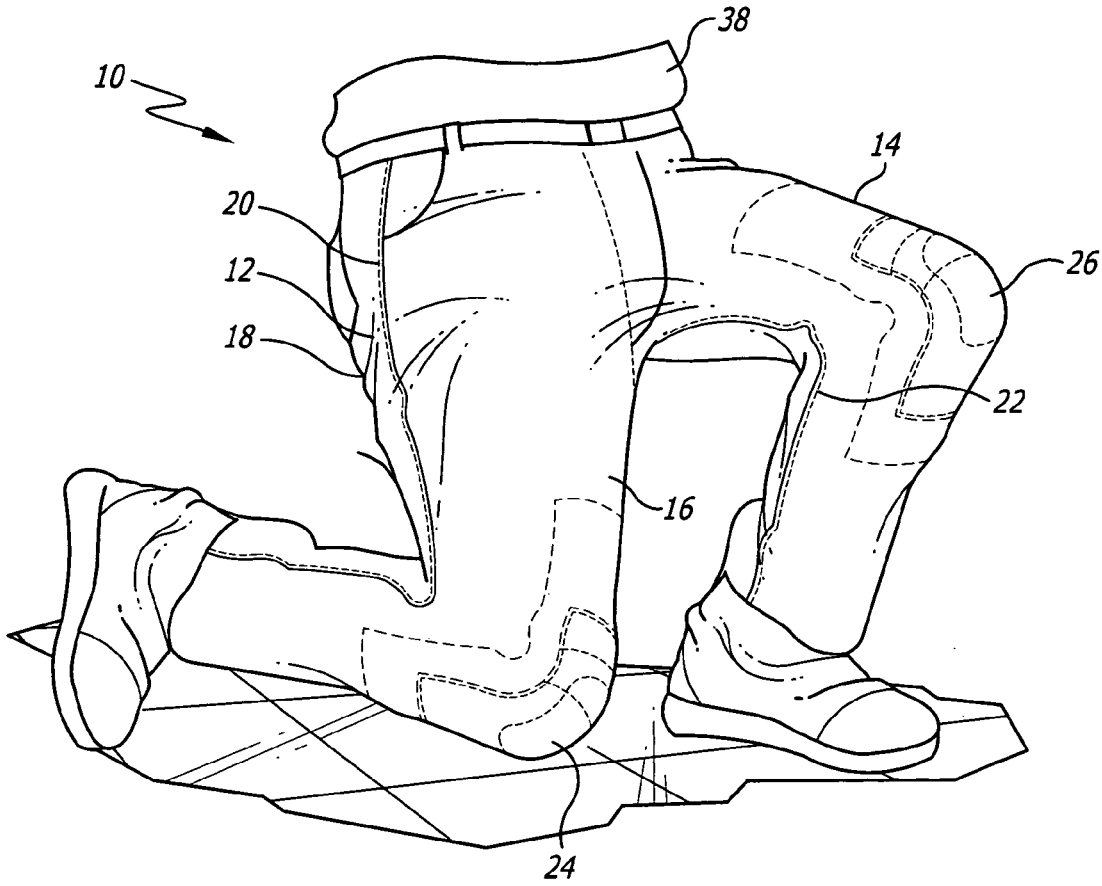
FIG. 1 is a perspective view of the lower half of a man wearing a pair of trousers having associated therewith the adjustable location knee pad structure of this invention shown in dashed lines.

FIG. 1 shows a pair of trousers 10 positioned as if they would be on a wearer who is kneeling on his right knee. The trousers 10 have a right leg 12 and a left leg 14. In conventional trousers the legs are made up of front and back panels. The front panel 16 and back panel 18 of the right trouser leg 14 are specifically identified. In the finished trousers they are secured together by a conventional inseam and an outseam 20. The corresponding conventional inseam on the left trouser leg 14 is indicated at 22. The trousers are made up of a suitable fabric for trousers in which the person is going to be kneeling, such as chino or denim.

Attached inside of each front panel is a knee pad assembly. The knee pad assembly 24 is shown in the right leg 16 in FIG. 1. A similar knee pad assembly 16 is installed on the inside of the front panel of the left leg 14, as also seen in FIG. 1. The knee pad assemblies are identical, and the knee pad assembly 24 will be described in detail in FIGS. 2, 3 and 4.

Figure 2:
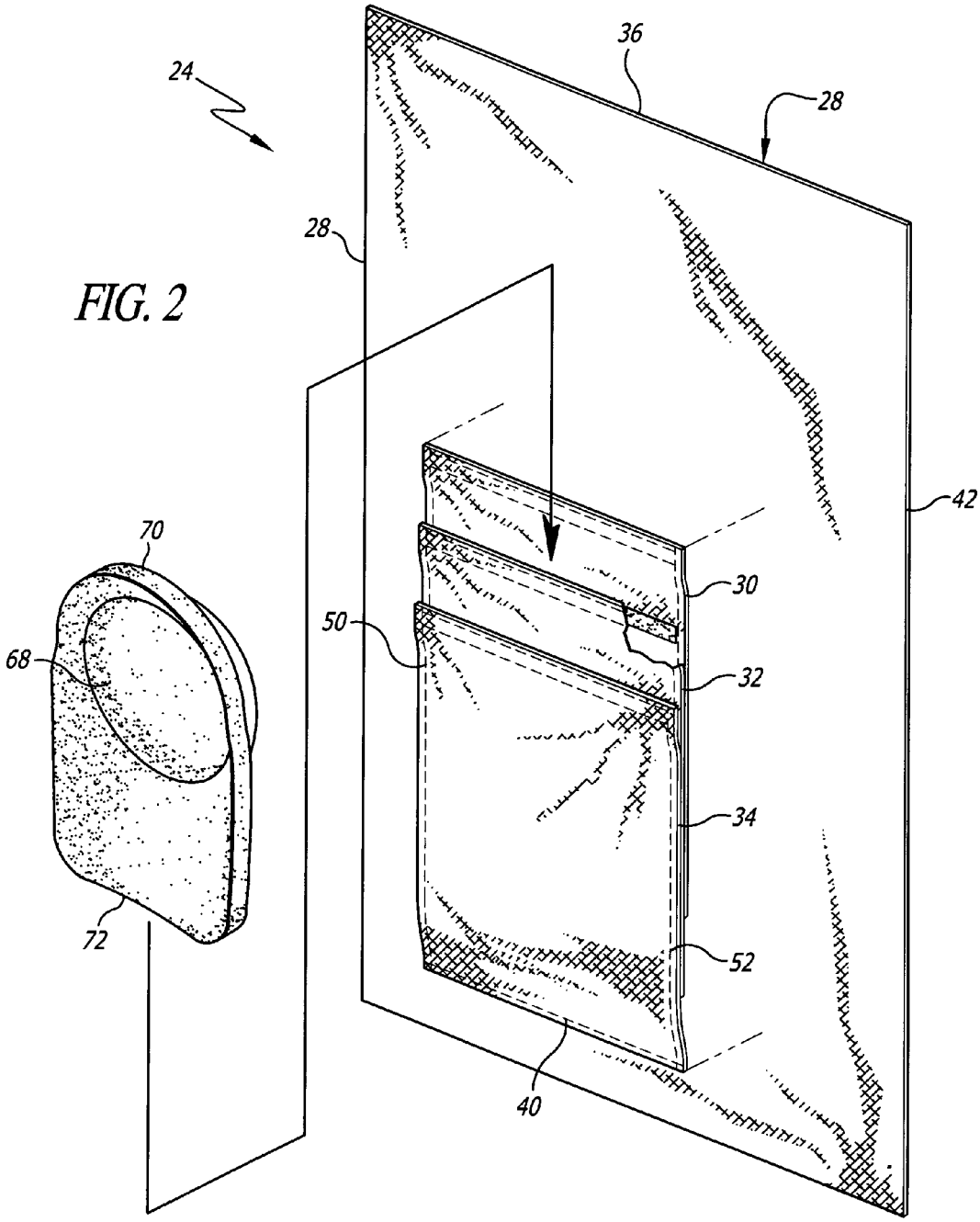
FIG. 2 is an exploded perspective view of the knee pad pocket structure and the knee pad.

The knee pad assembly 24 is formed of four panels 28, 30, 32 and 34. These panels are each of flexible material, such as cloth. Attachment panel 28 has a top edge 36 which is sufficiently long to extend up to attach into the sewing of the waistband 38. Its left and right edges 40 and 42, as seen in FIG. 2, are sufficiently wide apart that they can be sewn into the outseam 20 and the corresponding inseam. By this means, the attachment panel can be inserted into the trousers as they are being assembled and sewn. The length of the attachment panel 28 is such that the pocket panels 30, 32 and 34, which are attached to the attachment panel, are positioned approximately at the knee and upper shin of the wearer of the trousers.

Figure 3:
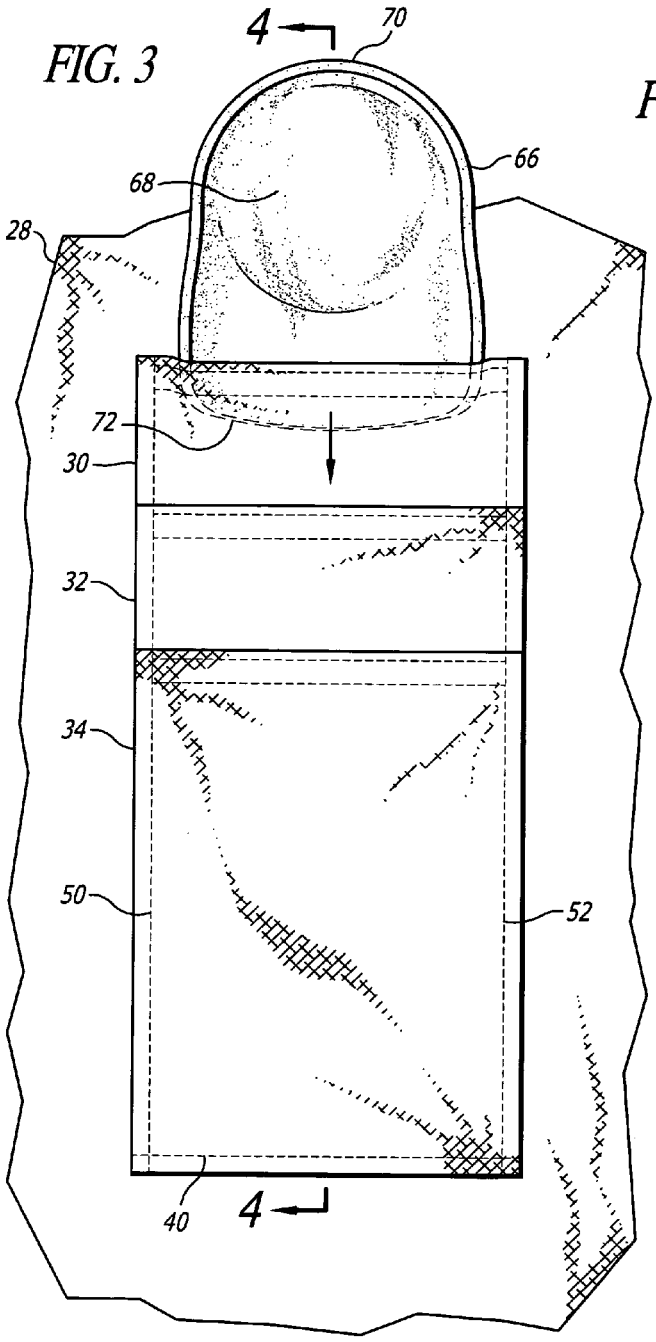
FIG. 3 is a front elevational view of the knee pad structure, with a knee pad about to be inserted into a selected pocket.
Figure 4:
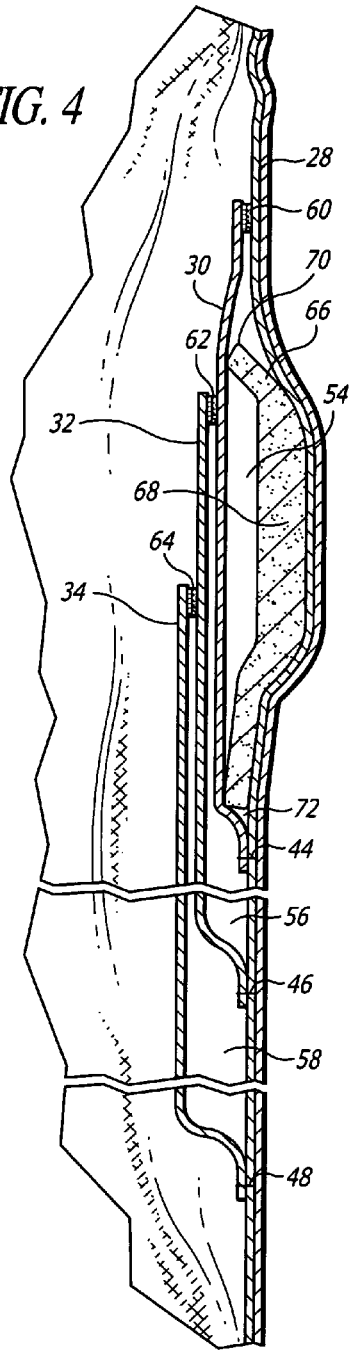
FIG. 4 is a section taken generally along line 4—4 of FIG. 3.

As seen in FIGS. 2, 3 and 4, the pocket panels 30, 32 and 34 are of equal size and are positioned in overlapped relationship with each other. The tops of the pocket panels are staggered so that a pocket panel 30 is highest; the pocket panel 32 is next highest; and the next pocket panel 34 is lowest. The pocket panel 30 is sewn to the attachment panel at its lower edge at seam line 44. The pocket panel 32 is attached to the attachment panel on its lower edge at seam line 46. The lowest pocket panel 34 is attached at its lower edge to the attachment panel at the seam line 48. The overlapped pocket panels are attached to the attachment panels along their left and right edges by left seam line 50 and right seam line 52, as seen in FIGS. 2 and 3. This attachment creates three pockets 54, 56 and 58, see FIG. 4.

Each of the pockets is substantially the same size between its side seam lines and bottom seam line.

The tops of the pockets are unseamed, and they are open except for detachable closures 60, 62 and 64. The detachable closures are disclosed as hook-and-loop fasteners, which is the preferred closure structure. However, the tops of the pockets can be closed otherwise by such structures as zippers or buttons. It is desirable that the tops of these pockets be closeable because they should not be open when the trousers are put on. In putting on the trousers, the wearer inserts his leg down through the trouser leg, and his foot would engage into the top of one of the pockets if it were not closed.

Knee pad 66 is substantially rectangular and is of substantially uniform thickness. It is made of resilient material such as synthetic polymer composition foam, such as polyurethane foam. The foam should be resilient enough to be soft under the knees but not so soft that it completely crushes under the weight of the knee. The thickness of the knee pad can be related to the firmness thereof. While the knee pad is of substantially uniform thickness, it preferably has a dome 68 therein. The concave side of the dome is seen in FIG. 4, while the convex side is seen in FIG. 3. The length of the knee pad from the top edge 70 to the bottom edge 72 is slightly less than the distance from the top to the bottom of each pocket. As can be seen in FIGS. 2, 3 and 4, the dome is positioned closer to the top edge than to the bottom edge 72.

As seen in FIGS. 3 and 4, the knee pad 54 can be slipped into any one of the pockets and retained therein. In order to position the knee pad in accordance with the desires of the particular user, the knee pad 54 can be alternatively positioned in the first pocket 54, the second pocket 56 or the third pocket 58. Thus, there are three locations, up and down the trouser leg, in which the knee pad can be positioned at the choice of the user. The positioning of the dome 68 close to the top edge 70 in the pad 66 is to permit the lower portion of the pad below the dome 68 to extend along the upper shin of the user below his knee, as seen in FIG. 1. The user selects the pocket into which the pad is inserted in such a manner as to achieve protection both for his knee and for his upper shin. As can be seen in FIG. 1, the structure bends at the knee pad. In order to permit the knee pad 54 to bend at the right place, it is configured with curved-in sides.

As previously discussed, the attachment panel is sufficiently large and configured so that the pocket panels can be sewn thereto, and then the attachment panel can be gathered into the trousers as they are being assembled. An attachment panel of this size permits easy insertion of the enclosed pockets into the correct location within the trouser legs.

The knee pad assembly 68 is ready to be installed on the interior of the trousers at the knee. Fabric panel 90 represents the front of the trouser leg at the knee. When the user is ready he can attach the knee pad assembly to the interior surface. This is accomplished by sewing the backing layer to the inside of the trouser panel along seams lines 92 and 94. In this way, the knee pad 70 can be attached to the interior of trousers which are already sewn up. The backing layer 86 permits the knee pad assembly to be merchandised separately from the trousers and sewn in during or after the completion of trouser assembly.

This invention has been described in its presently contemplated best modes and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A knee pad assembly comprising:

an attachment panel;

a plurality of pocket panels, each of said pocket panels having first and second side edges, a bottom edge and a top edge, each of said pocket panels being attached to said attachment panel adjacent said first and second edges and adjacent said bottom edge, each defining a pocket openable at said top edge;

detachable attachment structure interconnected between said top edge of each of said pocket panels and said attachment panel so that said pockets can be opened and closed by opening and closing said detachable attachment structure, said plurality of pocket panels being in overlapping position on said detachable attachment structure with the top edge of each of said pocket panels being directed toward the waistband in trousers when the kneepad assembly is secured within the leg of trousers; and a pad, said pad being sized to be engaged in a selected one of said pockets defined by said pocket panels and enclosed within said selected pocket when said detachable attachment structure is attached, so that said kneepad assembly can be attached into the interior of trousers so that said pad can protect the knee of the wearer of the trousers when the wearer is kneeling.

2. The knee pad assembly of claim 1 wherein said detachable attachment structure is selected from the group comprising: hook-and-loop fasteners, buttons, zippers and snaps.

3. The knee pad assembly of claim 1 wherein said detachable attachment structure is selected from the group comprising: hook-and-loop fasteners, buttons, zippers and snaps.

4. The knee pad assembly of claim 1 wherein said pad for insertion into said selected one of said pockets is a pad configured and sized at substantially the same outline as said pocket into which it is to be inserted, said pad having a dome therein which is configured to receive the knee of the user when he is kneeling and said pad extends from said dome a greater distance to said bottom edge of said pad than said top edge of said pad so that said pad below said dome can be positioned under the upper shin of the wearer.

5. The knee pad assembly of claim 1 wherein said pocket panels comprises at least first, second and third pocket panels defining at least first second and third pockets, said first, second and third pockets being overlapped with said first pocket having its open top edge directed toward the top of said attachment panel and said second pocket panel overlying a portion of said first pocket panel and having its top edge facing said top edge of said attachment panel and said third pocket panel having its open edge facing said top edge of said attachment panel and being farther away from said top edge of said attachment panel than said second pocket panel, said first, second and third pocket panels each being attached along their first edge with a first stitch line and along their second end with a second stitch line.

6. A knee pad assembly comprising:

an attachment panel, said attachment panel having first and second edges, a top edge and a bottom edge, said attachment panel being sized to be able to be sewn into trousers during assembly and sewing of the trousers, said bottom edge of said attachment panel extending below the knee position of the trousers;

a plurality of pocket panels each having first and second side edges, a bottom edge and a top edge, said plurality of pocket panels being attached to said attachment panel at said first and second side edges and bottom edge of each said pocket panel, said plurality of pocket panels being progressively attached to said attachment panel in overlapping relationship, with each said top edge being directed toward said top edge of said attachment panel to define a pockets open toward said top edge of said attachment panel;

a detachable attachment structure at said top edge of each said pocket panel to selectively open and close each said pocket panel to define openable pockets; and a resilient pad sized to fit within a selected one of said pockets and be retained within a selected one of said pockets by closure of said attachment structure when said resilient pad is within said selected pocket.

7. The knee pad assembly of claim 6 wherein said attachment structure is selected from the group comprising: hook-and-loop fasteners, buttons, zippers and snaps.

8. The knee pad assembly of claim 6 wherein the left side of each of said pocket panels and the right side of each of said pocket panels are in alignment and are attached to said attachment panel by the same stitch line.

9. The knee pad assembly of claim 6 wherein there is a pad in said selected one of said pockets defined by said pocket panels, said pocket panels and said pad being configured and positioned to be engaged both by the knee and upper shin of the wearer of the trousers when he is kneeling.

10. The knee pad assembly of claim 9 wherein there is a dome in said pad, said dome being positioned to receive the knee of the wearer and said pad is configured so that there is sufficient pad to be engaged by the upper shin of the wearer when he is kneeling.

11. A knee pad assembly:

an attachment panel, said attachment panel having first and second side edges, a top edge and a bottom edge;

a first pocket panel having a left edge and a right edge, a bottom edge and a top edge, said first pocket panel being attached to said attachment panel with its top edge toward said top edge of said attachment panel;

a second pocket panel having a left edge, a side edge, a top edge and a bottom edge, said second pocket panel being substantially the same size as said first pocket panel, said second pocket panel being positioned to partially overlay said first pocket panel and partially overlay said attachment panel with said top edge of said second attachment panel facing said top edge of said attachment panel, said bottom edges of said first and second pocket panels being attached to said attachment panel, said first and second edges of said first and second pocket panels being attached to said attachment panel on seam lines engaging both of said pocket panels where they are overlapped;

detachable attachment structure at the top edge of said first pocket panel, detachable attachment structure at said top edge of said second pocket panel;

a pad sized to selectively fit within the pocket defined by said first pocket panel or within said pocket defined by said second pocket panel, said attachment structure being for opening a selected pocket panel for insertion of said pad and closure of said pocket panel to close said pocket panel.

12. The knee pad assembly of claim 11 wherein said attachment panel is sized to position one of said pocket panels at the knee of a wearer of the trousers when he is kneeling so that the pad protects his knee and upper shin during kneeling.

13. The knee pad assembly of claim 11 wherein said closure structure is selected from the group comprising hook-and-loop fasteners, buttons, zippers and snaps.

* * * * *